US011358855B2

(12) United States Patent
Walton et al.

(10) Patent No.: US 11,358,855 B2
(45) Date of Patent: Jun. 14, 2022

(54) VALVE CLOSURE INCORPORATING AN OVER-PRESSURE RELIEF VALVE

(71) Applicants: Philip Andrew Walton, Bishop Auckland (GB); Sergio Sonzogni, Grassobbio (IT); Robert Tansley, Bishop Auckland (GB); Andrew Gibbs, Bishop Auckland (GB)

(72) Inventors: Philip Andrew Walton, Bishop Auckland (GB); Sergio Sonzogni, Grassobbio (IT); Robert Tansley, Bishop Auckland (GB); Andrew Gibbs, Bishop Auckland (GB)

(73) Assignee: POLYKEG S.R.L.

( * ) Notice: Subject to any disclaimer, the term of this patent is extended or adjusted under 35 U.S.C. 154(b) by 185 days.

(21) Appl. No.: 16/645,070

(22) PCT Filed: Sep. 6, 2018

(86) PCT No.: PCT/GB2018/052531

§ 371 (c)(1),
(2) Date: Mar. 6, 2020

(87) PCT Pub. No.: WO2019/048868

PCT Pub. Date: Mar. 14, 2019

(65) Prior Publication Data

US 2020/0307982 A1 Oct. 1, 2020

(30) Foreign Application Priority Data

Sep. 7, 2017 (GB) ..... 1714383

(51) Int. Cl.
*B67D 1/08* (2006.01)

(52) U.S. Cl.
CPC ..... *B67D 1/0835* (2013.01); *B67D 1/0845* (2013.01)

(58) Field of Classification Search
CPC ..... B67D 1/0829–0854; B65D 51/16–1694
See application file for complete search history.

(56) References Cited

U.S. PATENT DOCUMENTS 3,228,413 A 1/1966 Stevens, Jr.
4,180,189 A * 12/1979 Zurit ..... B67D 1/0832 137/212

(Continued)

FOREIGN PATENT DOCUMENTS

EP 2505546 10/2012
FR 2905367 3/2008

(Continued)

*Primary Examiner* — Paul R Durand
*Assistant Examiner* — Randall A Gruby
(74) *Attorney, Agent, or Firm* — Galbreath Law Offices, P.C.; John A. Galbreath

(57) ABSTRACT

The valve closure (e.g. an A-type closure) has a closure body (1) for attachment to a container, a gas inlet port (14), a liquid dispensing port (25), and a valve member (6) to sealably close the gas inlet and liquid dispensing ports. An over-pressure relief valve (40) is configured to release gas from within the container in the event that an internal pressure limit is exceeded, and a user-operable depressurising lever (50) is arranged to permit the over-pressure relief valve to be manually opened. The over-pressure relief valve (40) comprises a plunger (53) which is urged against a seat (52) by a spring (57), and the depressurising lever (50) incorporates an abutment (58) for the spring (57). The plunger (53) includes an arrowhead formation (59) by which the depressurising lever (50) engages the plunger to hold the valve open during manual operation. The depressurising lever (50) incorporates an integral hinge (62) which also forms a frangible connection so that the lever becomes detached from the closure body and permanently opens the over-pressure release valve when manually operated.

8 Claims, 4 Drawing Sheets

(56) References Cited

U.S. PATENT DOCUMENTS

| | | | | |
|---|---|---|---|---|
| 4,350,270 | A * | 9/1982 | Nezworski | B67D 1/0832 222/336 |
| 4,516,698 | A * | 5/1985 | Cerrato | B67D 1/0829 222/341 |
| 8,727,160 | B2 * | 5/2014 | Fuchs | B67D 1/0845 220/203.04 |
| 9,815,676 | B2 * | 11/2017 | Witte | B67D 1/0462 |
| 10,882,729 | B2 * | 1/2021 | Ye | B67D 1/125 |
| 2009/0320264 | A1 * | 12/2009 | Berger | B29C 66/114 29/428 |
| 2012/0248109 | A1 | 10/2012 | Fuchs et al. | |
| 2015/0108175 | A1 * | 4/2015 | Wauters | B67D 1/125 222/400.7 |
| 2015/0274502 | A1 * | 10/2015 | Kuhn | B67D 1/0831 222/397 |
| 2020/0180933 | A1 * | 6/2020 | Paauwe | B67D 1/0462 |

FOREIGN PATENT DOCUMENTS

| | | |
|---|---|---|
| GB | 2508303 | 5/2014 |
| WO | WO 2013/159159 | 10/2013 |

* cited by examiner

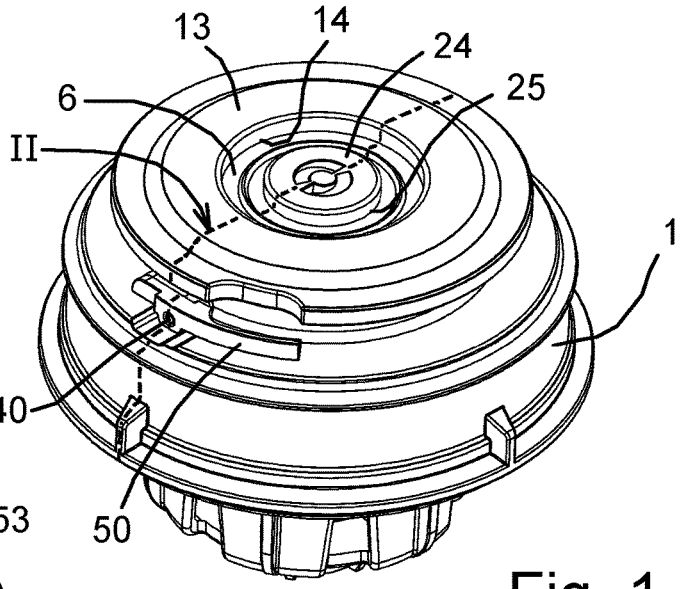
Fig. 1
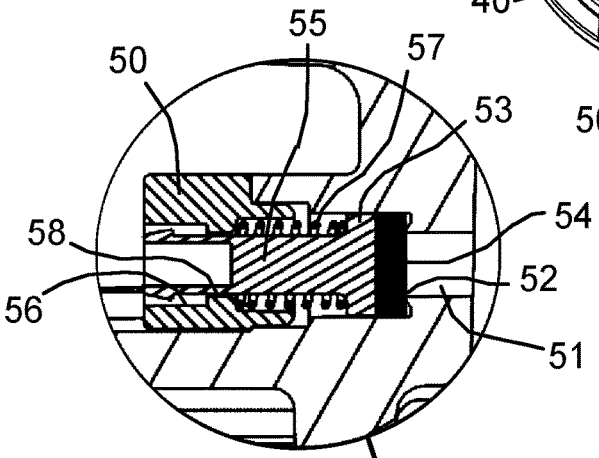
Fig. 2
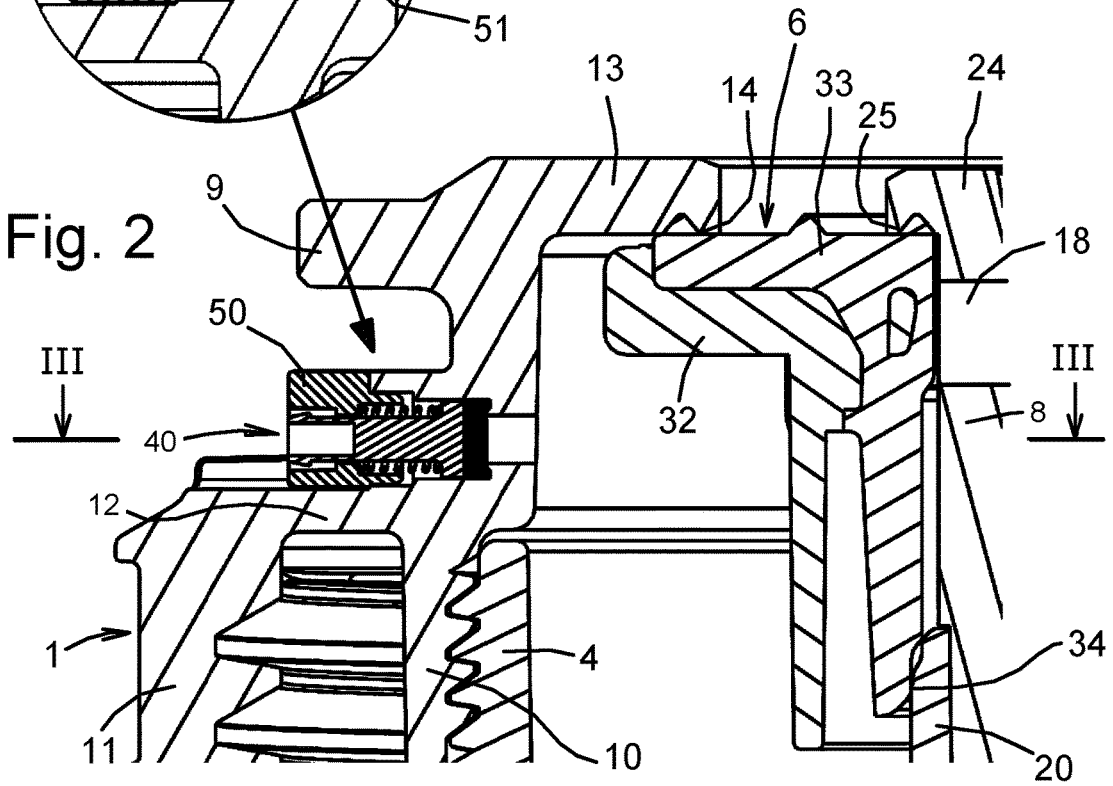

VALVE CLOSURE INCORPORATING AN OVER-PRESSURE RELIEF VALVE

TECHNICAL FIELD OF THE INVENTION

This invention relates to closures which incorporate valves. Such closures are used with liquid containers such as beer kegs and are configured to enable the liquid contents to be dispensed by gas pressure.

BACKGROUND

A common form of valve closure which is often used with beer kegs is known as an A-type valve. A single spring-loaded annular valve element controls two ports. When engaged with a suitable valve-operating member, gas can be fed into the container past the outer periphery of the valve element while beer simultaneously flows out of the container past the inner periphery of the element.

Other forms of valve closure may also be used with beer kegs. For example, in S-type valves the two ports are controlled by inner and outer concentric valve members which are spring-loaded to close inner and outer passages within the valve closure. Generally the valve members are operated by respective spring elements, although the valve members may be cascaded such that one spring-loaded valve member causes closure of the other.

Stretch blow mounded containers which contain beer, other pressurised liquids, or non-pressurised liquids which are dispensed under pressure, may be subject to significant internal pressures. The maximum pressure which should not be exceeded is usually stated on the container. If the pressure limit is exceeded a potentially dangerous bursting situation can occur. The internal pressure within the container is affected by several factors including the initial gas content, temperature, post-filling fermentation processes, connection to dispensing systems, etc. It is therefore desirable to incorporate an over-pressure relief valve to prevent an excessive pressure rise.

A high pressure gas is often used to dispense the contents of the container, and some of the gas normally remains under pressure inside the container after use. In the case of single use containers such as beer kegs it is desirable to vent the container after use in order to remove a possible hazard during the disposal or recycling process. Bar staff or other users may use a tool to operate the valve closure and relieve the internal pressure, but this is unreliable, inconvenient for the users, and the procedure cannot be carried out if a suitable tool is not available.

FR 2 905 367 A1 discloses an A-type valve closure for metal beer barrels which includes an over-pressure relief valve (28) which is configured to release gas from within the container in the event that an internal pressure limit, typically 4 bar, is exceeded. A user-operable depressurising ring (30) allows manual opening of the over-pressure relief valve.

Present liquid containers such as beer kegs are not designed to withstand multiple use, and there is nothing to prevent containers fitted with the existing valve closures from being re-filled and re-used multiple times.

SUMMARY OF THE INVENTION

When viewed from one aspect the present invention provides a valve closure incorporating user-operable depressurising means (50) configured to permanently open an over-pressure release valve (40) when manually operated.

The invention also provides a valve closure incorporating an over-pressure relief valve (40) which comprises a plunger (53) which is urged against a seat (52) by a spring (57), and the user-operable depressurising means (50) and the plunger (53) are separate components.

The invention also provides a valve closure incorporating an over-pressure relief valve (40) which comprises a plunger (53) which is urged against a seat (52) by a spring (57), wherein the user-operable depressurising means (50) and the plunger (53) are separate components, wherein the user-operable depressurising means (50) incorporates an abutment (58) for the spring (57), and wherein the user-operable depressurising means (50) is manually movable such that the abutment (58) moves away from the plunger (53).

The invention also provides a valve closure incorporating an over-pressure relief valve (40) which comprises a plunger (53) and includes a formation (59) by which user-operable depressurising means (50) engages the plunger during manual operation to hold the over-pressure relief valve open.

The invention also provides a valve closure incorporating user-operable depressurising means (50) which is configured to become detached from the closure body when manually operated.

The invention also provides a valve closure incorporating user-operable depressurising means (50) which comprises a lever arm (50) which is connected to the closure body (1).

The invention also provides a valve closure incorporating user-operable depressurising means (50) which comprises a lever arm (50) which is formed of resiliently flexible material.

The invention also provides a valve closure incorporating user-operable depressurising means (50) which comprises a lever arm (50) which incorporates an integral hinge (62).

The invention also provides a valve closure incorporating user-operable depressurising means (50) which comprises a lever arm which is connected to the closure body (1) and incorporates a frangible connection (62) by which at least part of the lever arm breaks away from the closure body.

BRIEF DESCRIPTION OF THE DRAWINGS

The following description and the accompanying drawings referred to therein are included by way of non-limiting example in order to illustrate how the invention may be put into practice. In the drawings:

FIG. 1 is a general view of an A-type valve closure for attachment to a container;

FIG. 2 is a detailed axial section through an upper portion of the valve closure on the plane II indicated in FIG. 1;

DETAILED DESCRIPTION OF THE DRAWINGS

Figure 3:
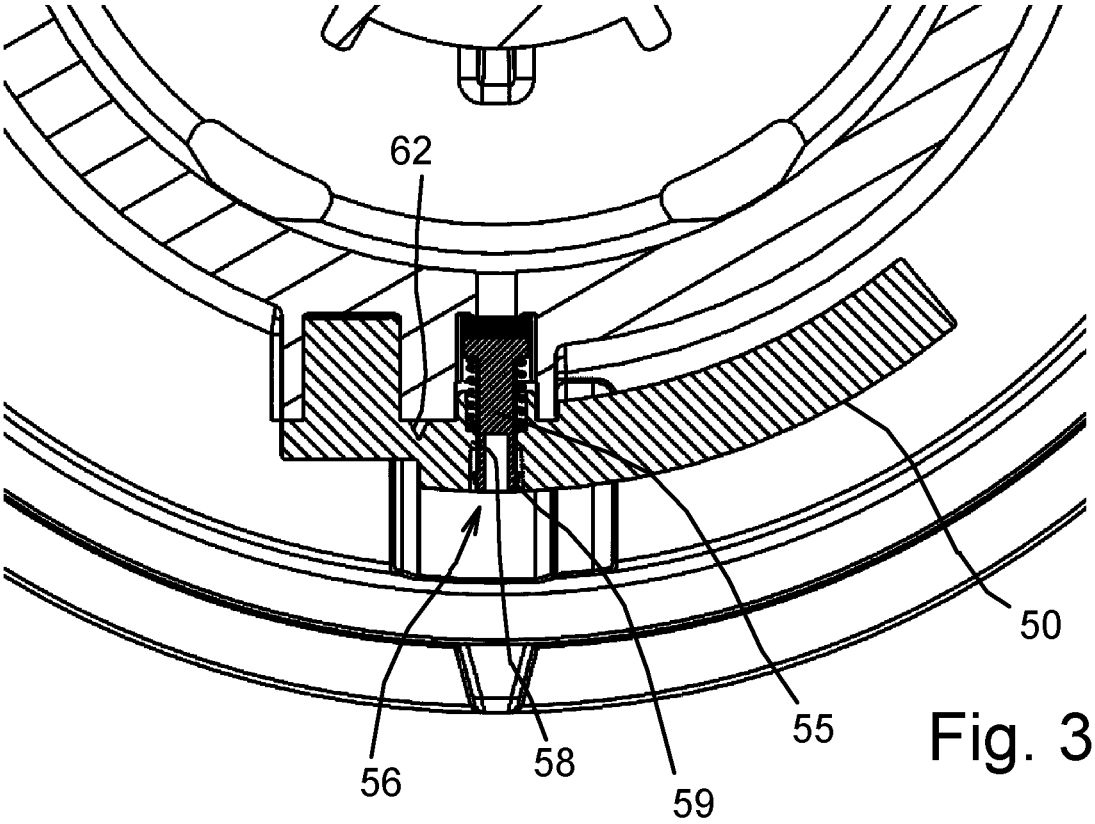
FIG. 3 is a transverse cross section through the upper portion of the valve closure on the plane III indicated in FIG. 2.

Referring firstly to FIG. 1, the valve closure shown in the drawing is of the kind known as an A-type valve. All components of the valve closure may be moulded of polymeric materials (plastics) so that the closure is fully recyclable. A preferred form of valve closure is described in EP 2 585 400 A1.

The valve closure comprises a closure body 1 which is adapted to be fitted onto the neck of a beverage container such as a beer keg which is typically formed by stretch blow moulding. The closure body 1 has an annular top wall 13 concentric with a disc-shaped cap 24. A valve member 6 is spring-loaded to be sealingly urged against an outer valve seat 14 formed around the inner periphery of the annular top wall 13 and an inner valve seat 25 formed around the periphery of the cap 24. When, in use, the valve member 6 is engaged by a valve-operating member (not shown), the valve member is depressed against its spring-loading and makes sealing contact with the valve-operating member to provide separate gas and liquid flow paths through the valve-operating member. Pressurised gas is fed into the container through a gas inlet port formed between the outer valve seat 14 and the outer periphery of the valve member 6 and liquid simultaneously flows out of the container through a liquid dispensing port formed between the inner valve seat 25 and the inner periphery of the valve member.

In this embodiment the valve closure contains a radially-disposed over-pressure relief valve 40 which can be operated by a depressurising lever 50 as described below.

Referring to FIG. 2, the closure body 1 has an inner cylindrical wall 10 and an outer cylindrical wall 11 connected by an annular bridging wall 12. The outer wall has internal threads to screw onto the neck of the container which seals against bridging wall 12 to withstand differential gas pressure. The inner cylindrical wall 10 extends upwardly beyond the bridging wall 12 to join the annular top wall 13, and an annular top flange 9 projects outwardly above the bridging wall 12. The inner cylindrical wall 10 is internally screw-threaded to non-sealingly receive a bottom end fitting 4. The fitting 4 incorporates an inner co-axial sleeve 20 and provides axial openings for admitting pressurised gas into the container. A dip tube (not shown) is received within the lower end of the sleeve 20 for conducting liquid out of the container, and a hollow valve stem 8 is engaged within the upper end of the sleeve 20. Valve stem 8 is open at the lower end to communicate with the dip tube but is closed at the upper end by the disc-shaped cap 24. Below the cap 24 the valve stem contains side ports 18.

The valve member 6 includes a rigid support element 32 and a flexible sealing element 33 which is shaped to seal against the two valve seats 25 and 14. A compression spring, which is preferably as described in EP 2 585 400 A1, bears against the underside of the support element 32 to maintain spring pressure on the two valve seats 25 and 14 and prevent escape of gas or liquid from the container. The inner margin of the sealing element 33 also forms a sliding seal 34 with the upper outer margin of the sleeve 20. When the valve member 6 is engaged by the valve-operating member as described above, high pressure gas is admitted into the container between the inner cylindrical wall 10 and the sleeve 20 causing liquid to exit via the feed tube, stem 8, and side ports 18. The sliding seal 34 prevents escape of pressurised gas into the liquid flowing through stem 8.

FIG. 2 also shows the over-pressure relief valve 40. Between the bridging wall 12 and the flange 9, the inner cylindrical wall 10 contains an orifice 51. The orifice is stepped to form an outwardly-directed seat 52 to co-operate with a plunger 53 which is received in the wider-diameter outer end of the orifice. The plunger 53 includes a flexible sealing disc 54 to seal against the seat 52 and includes a pin 55 which extends slidably into a bore 56 in manually-operable depressurising lever 50. A compressive loading spring 57 located about the pin 55 acts between the plunger 53 and an annular abutment 58 in the bore 56 to urge the sealing disc into sealing contact with the seat 52. The spring load and the diameter of the orifice 51 are chosen such that the plunger moves out of sealing contact with the seat 52 when gas within the container reaches a predetermined maximum internal pressure, thereby acting as an automatic over-pressure relief valve.

Figure 4:
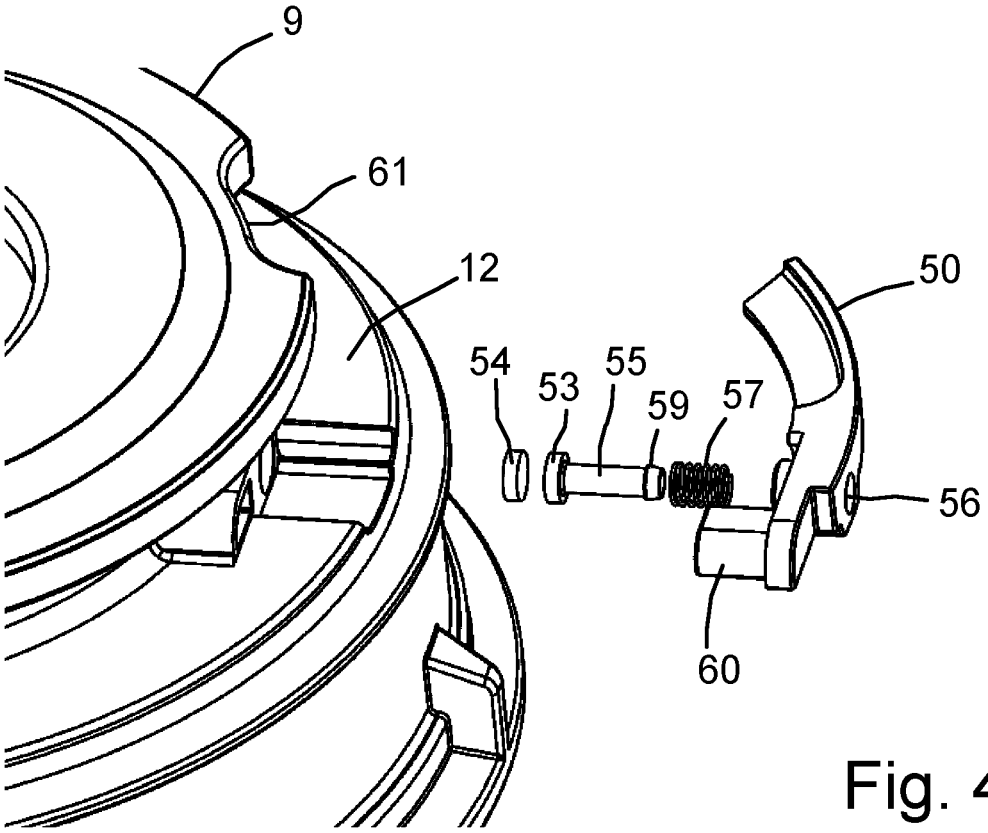
FIG. 4 is a general view of the upper portion of the valve closure, partly exploded.
Figure 5:
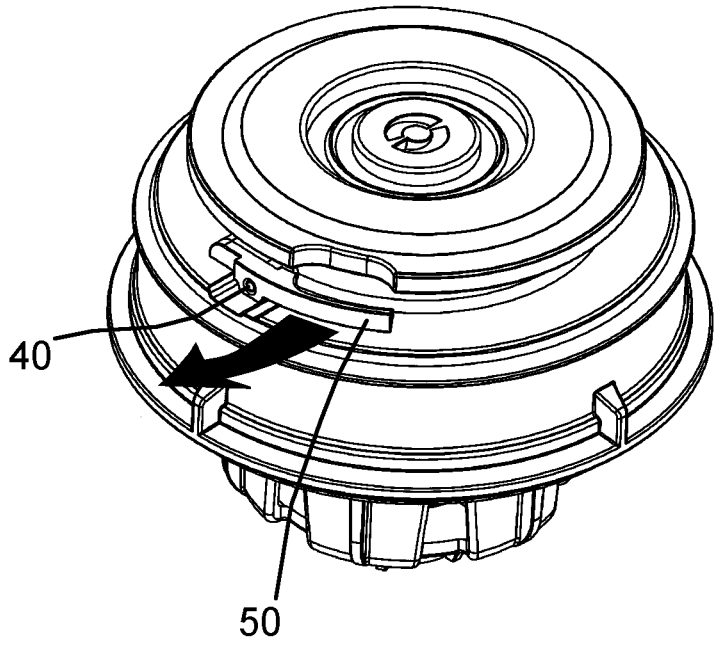
FIG. 5 is a general view of the upper portion of the valve closure as assembled.

Referring now to FIGS. 3 and 4, the outer end of the pin 55 is provided with an arrowhead formation 59 which allows the pin to be inserted into the bore 56 but, when inserted, co-operates with the annular abutment 58 to retain the plunger in the bore. The lever 50 is moulded from a resiliently flexible polymer (acetal or similar) and is curved to fit snugly between the bridging wall 12 and the flange 9. The bore 56 is formed adjacent to a fixed end of the lever which is provided with an integral attachment peg 60 which is inserted into the inner wall 10 to attach the lever to the closure body 1. The flange 9 contains a notch 61 which enables the free end of the lever to be accessed easily when it is desired to manually vent the container. The inherent flexibility of the lever allows the free end to be pulled outwardly, as indicated by the arrow in FIG. 5. This relieves the spring pressure on the plunger 53 so that the internal pressure required to operate the over-pressure release valve is progressively reduced as the lever is pulled, and the gas pressure within the container will start to be released as soon as the opening pressure is reached. If the lever is pulled sufficiently far that the arrowhead formation 59 engages the annular abutment 58 the depressurising lever will hold the plunger away from the valve seat so that the gas will continue to be vented until the internal and external pressures become equalised.

It will therefore be appreciated that operation of the depressurising lever causes the venting process to start smoothly and the rate of venting to be controlled. Provided the lever is not released, venting will continue until all of the internal pressure has gone.

Figure 6:
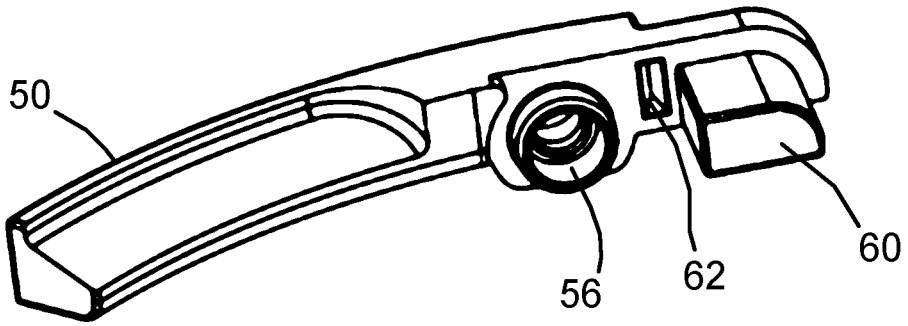
FIG. 6 is a general view of the depressurising lever of the valve closure.
Figure 7:
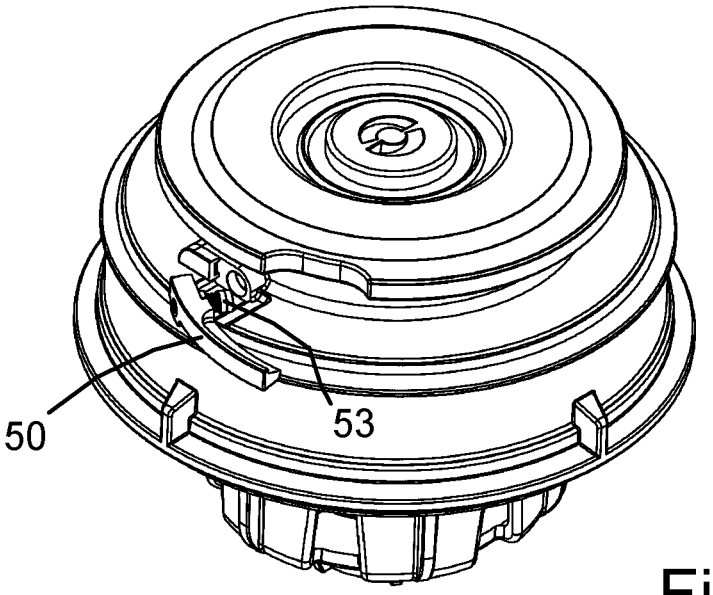
FIG. 7 is a general view of the upper portion of the valve closure in use to depressurise a container.

The depressurising lever 50 also has a further significant feature which can best be understood by considering FIGS. 3 and 6. The inner face of the lever contains a shallow groove 62 between the attachment peg 60 and the bore 56, forming a weak point in the lever profile. The groove 62 acts as both an integral hinge and a frangible connection. Firstly, the integral hinge reduces the pressure required to operate the lever during manual venting. Secondly, if the lever is pulled further out from the closure body, beyond the position where manual venting takes place, the lever will fracture at the weak point allowing the main part of the lever to come free, as shown in FIG. 7. Since the plunger 53 is attached to the lever by the arrowhead formation 59 and abutment 58 the plunger will come out of the orifice 51 which permanently depressurises the container. The absence of the lever acts as a telltale flag indicating that the container has been permanently depressurised, cannot be re-used, and can safely be disposed of or recycled.

It is important to note that the over-pressure relief valve is fully functional to provide automatic over-pressure relief independent of the manual depressurisation feature. Furthermore both the relief valve and the depressurising lever are contained within the external profile of a standard valve closure.

It will be appreciated that although a preferred embodiment has been described, the over-pressure release valve and manually-operable depressurising member could take different forms. In other embodiments the valve plunger could be orientated axially within the inner cylindrical wall 10 with a pull-tab or ring-pull being provided in the top flange 9 to manually release the plunger.

Figure 8:
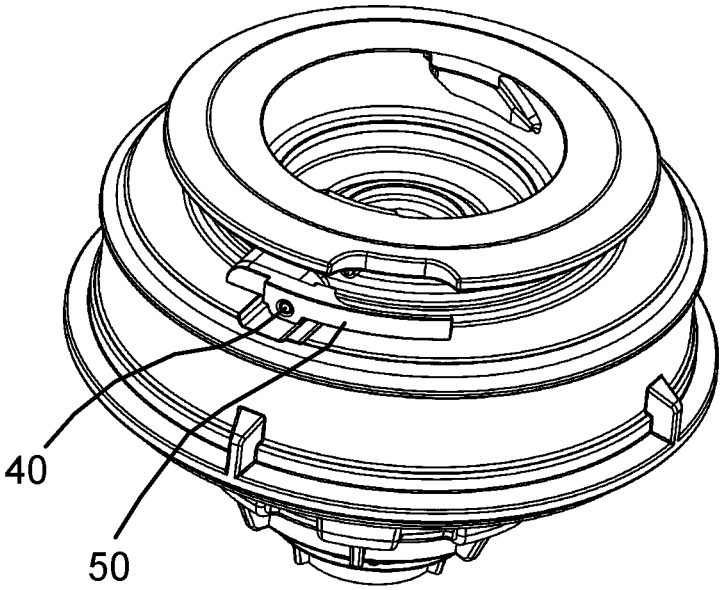
FIG. 8 is a general view of the upper portion of an S-type valve closure for attachment to a container.

The over-pressure release valve and depressurising lever can be applied to any format of valve closure in which the internal gas space lies adjacent to an external wall of the closure body. For example, FIG. 8 shows the over-pressure release valve and depressurising lever applied to an S-type closure.

Whilst the above description places emphasis on the areas which are believed to be new and addresses specific problems which have been identified, it is intended that the features disclosed herein may be used in any combination which is capable of providing a new and useful advance in the art.

The invention claimed is:

1. A valve closure:

a closure body (1) for attachment to a container, a gas inlet port (14), a liquid dispensing port (25), valve means (6) to sealably close the gas inlet and liquid dispensing ports, an over-pressure relief valve (40) which is configured to release gas from within the container in the event that an internal pressure limit is exceeded, and user-operable depressurising means (50) arranged to open the over-pressure relief valve, wherein the user-operable depressurising means (50) is configured to permanently open the over-pressure release valve (40) when manually operated, characterised in that the over-pressure relief valve (40) comprises a plunger (53) which is urged against a seat (52) by a spring (57), the user-operable depressurising means (50) and the plunger (53) are separate components, and the user-operable depressurising means (50) incorporates an abutment (58) for the spring (57).

2. A valve closure according to claim 1 in which the user-operable depressurising means (50) is manually movable such that the abutment (58) moves away from the plunger (53).

3. A valve closure according to claim 1 which includes a formation (59) by which the user-operable depressurising means (50) engages the plunger to hold the over-pressure relief valve open during manual operation.

4. A valve closure according to claim 1 in which the user-operable depressurising means (50) is configured to become detached from the closure body when manually operated.

5. A valve closure according to claim 1 in which the user-operable depressurising means (50) comprises a lever arm which is connected to the closure body (1).

6. A valve closure according to claim 5 in which the lever arm (50) is formed of resiliently flexible material.

7. A valve closure according to claim 5 in which the lever arm incorporates an integral hinge (62).

8. A valve closure according to claim 5 in which the lever arm incorporates a frangible connection (62) by which at least part of the lever arm breaks away from the closure body.

* * * * *